US007469517B2

(12) United States Patent
Moore et al.

(10) Patent No.: US 7,469,517 B2
(45) Date of Patent: Dec. 30, 2008

(54) CLOSURE TRANSFERRING MECHANISM

(75) Inventors: David Moore, Plainfield, IL (US); Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 736 days.

(21) Appl. No.: 11/005,543

(22) Filed: Dec. 6, 2004

(65) Prior Publication Data

US 2006/0118387 A1 Jun. 8, 2006

(51) Int. Cl.
*B65B 7/28* (2006.01)

(52) U.S. Cl. ..... 53/317; 53/281; 53/331.5

(58) Field of Classification Search ..... 53/281, 53/485, 488, 317, 331.5
See application file for complete search history.

(56) References Cited

U.S. PATENT DOCUMENTS 2,593,794 A * 4/1952 Resina ..... 279/23.1
3,805,488 A * 4/1974 Holstein ..... 53/317
4,184,523 A 1/1980 Carrigan et al.
4,506,489 A * 3/1985 Schieser et al. ..... 53/64
4,516,380 A * 5/1985 Buckner et al. ..... 53/282
5,339,600 A * 8/1994 Hamano et al. ..... 53/306
5,437,361 A * 8/1995 Ohmori et al. ..... 198/465.1
6,135,676 A 10/2000 Anderson
6,508,046 B1 1/2003 Resterhouse et al.
6,910,313 B2 * 6/2005 De Cardenas et al. ..... 53/53
7,200,975 B2 * 4/2007 Till ..... 53/253
7,331,157 B2 * 2/2008 Brown ..... 53/331.5
7,383,673 B2 * 6/2008 Till et al. ..... 53/136.1

* cited by examiner

*Primary Examiner*—Douglas A Hess
(74) *Attorney, Agent, or Firm*—Husch Blackwell Sanders LLP Welsh & Katz

(57) ABSTRACT

The present invention relates to a mechanism, system and method for transferring closures. More specifically, the invention relates to a mechanism, system and method for transferring a closure from a first station, preferably a closure chute to a second station, preferably a closure chuck, through the use of a button with a lobe.

5 Claims, 3 Drawing Sheets

CLOSURE TRANSFERRING MECHANISM

FIELD OF THE INVENTION

The present invention relates to a mechanism and system for transferring closures. More specifically, the invention relates to a mechanism and system for transferring a closure from a first station, preferably a closure chute to a second station, preferably a closure chuck.

BACKGROUND OF THE INVENTION

In a traditional capping operation, closures are transferred from a feeder to a capper for placing the closure on a suitable object. With the advent of thermoplastics and other flexible materials, closures such as caps often times are not cylindrical, and are referred to as "out-of-round" or oval. The larger the cap, the deeper the cap and the thinner the material from which it is made, the more likely it is that the cap will have "out of round" or ovality issues. Traditional capping apparatus often times have difficulty in handling out-of-round caps. However, caps that have a tendency to be out-of-round are often requested from a purchaser for functional, cost or aesthetic reasons. Therefore, an apparatus capable of handling out-of-round closures is desired.

SUMMARY OF THE INVENTION

The present invention provides a capping mechanism capable of handling closures, including out-of round closures. The mechanism can be capable of transferring a closure with an opening of a predetermined intended width from a first station to a second station. The system comprises a button attached to a moving device. The moving device can be capable of moving the button from proximate the first station to proximate the second station. The button can be capable of removing the closure from the first station and delivering it to the second station.

The button can have a base having an outer portion which tapers inward and upward toward a substantially planar inner portion. Preferably, the inner portion has a width that is greater than the intended width of the closure. The button can also have at least one lobe extending substantially perpendicular from the base. Preferably, the lobe can have a bottom section proximate the base, a middle section and a top section, and can define a lobe perimeter that tapers outward from the bottom section to the middle section and tapers inward from the middle section to the top section. Preferably, the width of the lobe perimeter at the middle section is slightly less than the intended width of the closure.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

BRIEF DESCRIPTION OF THE DRAWINGS

The features of the present invention which are believed to be novel are set forth with particularity in the appended claims. The invention may best be understood by reference to the following description taken in conjunction with the accompanying drawings, in the several figures of which like reference numerals identify like elements, and in which:

DETAILED DESCRIPTION OF THE DRAWINGS

It is often desirable to place a plurality of closures 12 onto a plurality of containers 58 or other suitable devices. Typically, the closures 12 will be transported to a capping facility in a cardboard box or other suitable device. The closures 12 can then be removed from the box and placed into a feeding mechanism 8, which can be any mechanism capable of feeding closures 12 into a capping operation.

Figure 1:
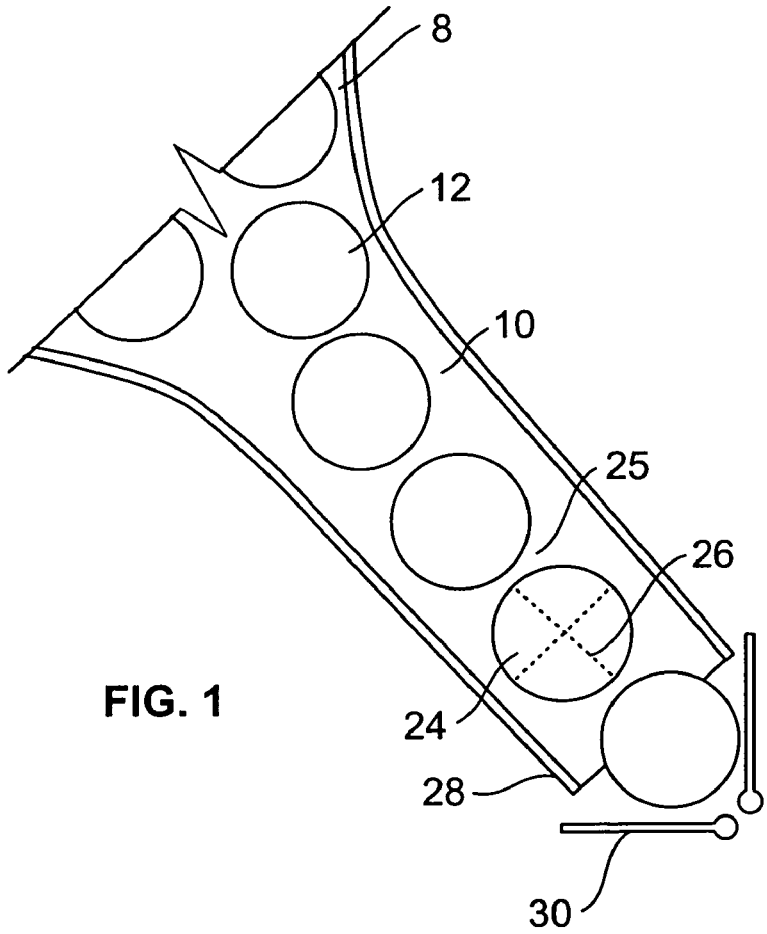
FIG. 1 is a perspective view of one embodiment of a system that can be used to transfer a closure from station to station.
Figure 2:
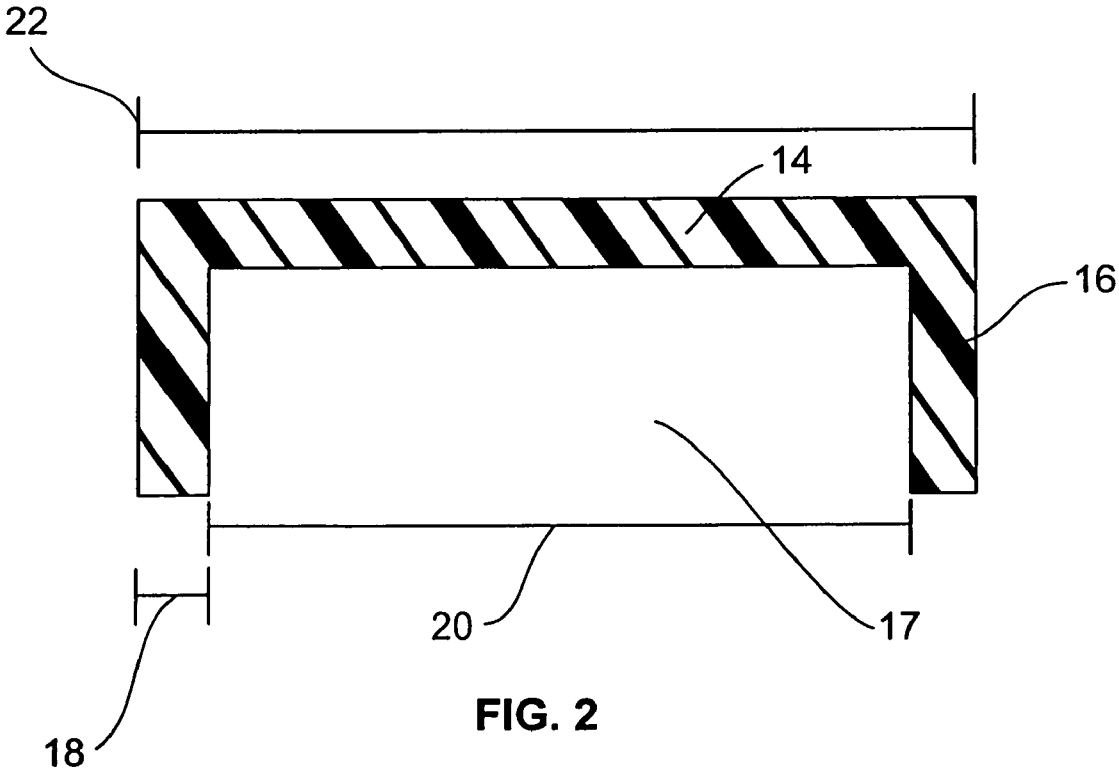
FIG. 2 is a perspective view of one embodiment of a mechanism that can be used to transfer a closure.

A preferred embodiment of the current invention is shown in FIGS. 1 and 2. As can be seen in FIGS. 1 and 2, a feeding mechanism 8 can have a closure chute 10 that holds a number of closures 12. Preferably, the closures 12 are perfectly round. However, due to manufacturing or other inconsistencies, closures 12 can be out-of-round or oval. Each closure 12 has a closure base 14 and a side wall 16 that extends from the closure base 14 at preferably a right angle or close thereto to form an open end 17. The sidewall 16 has a thickness 18 and, in round caps, defines an inner diameter 20 and an outer diameter 22. The sidewall 16 of oval caps will define an oval shape having a narrow axis 24 and a broad axis 26. In practice, the intended or desired width of a closure 12 will be the inner diameter 20 of a substantially round closure 12.

Preferably, the closure chute 10 has an end 28 that allows for the exit of one closure 12 at a time. Preferably, the closure chute 10 is at an angle relative to horizontal such that gravity helps to move the closures 12 toward the end 28. The closure chute 10 may vibrate or have a moving surface (not shown) to help move the closures 12 toward the end 28. The closure chute 10 preferably has a narrow section 25 that is slightly wider than a closure 12, which helps to feed closures one at a time. More preferably, the narrow section 25 is adjustable so that it can easily handle closures 12 of different diameters. The closure chute 10 preferably has hold backs 30 which will hold a closure 12 at the end 28. While held at the end 28, an oval closure 12 can be in a position where it is predominately narrow axis 24 or broad axis 26 leading.

Figure 3:
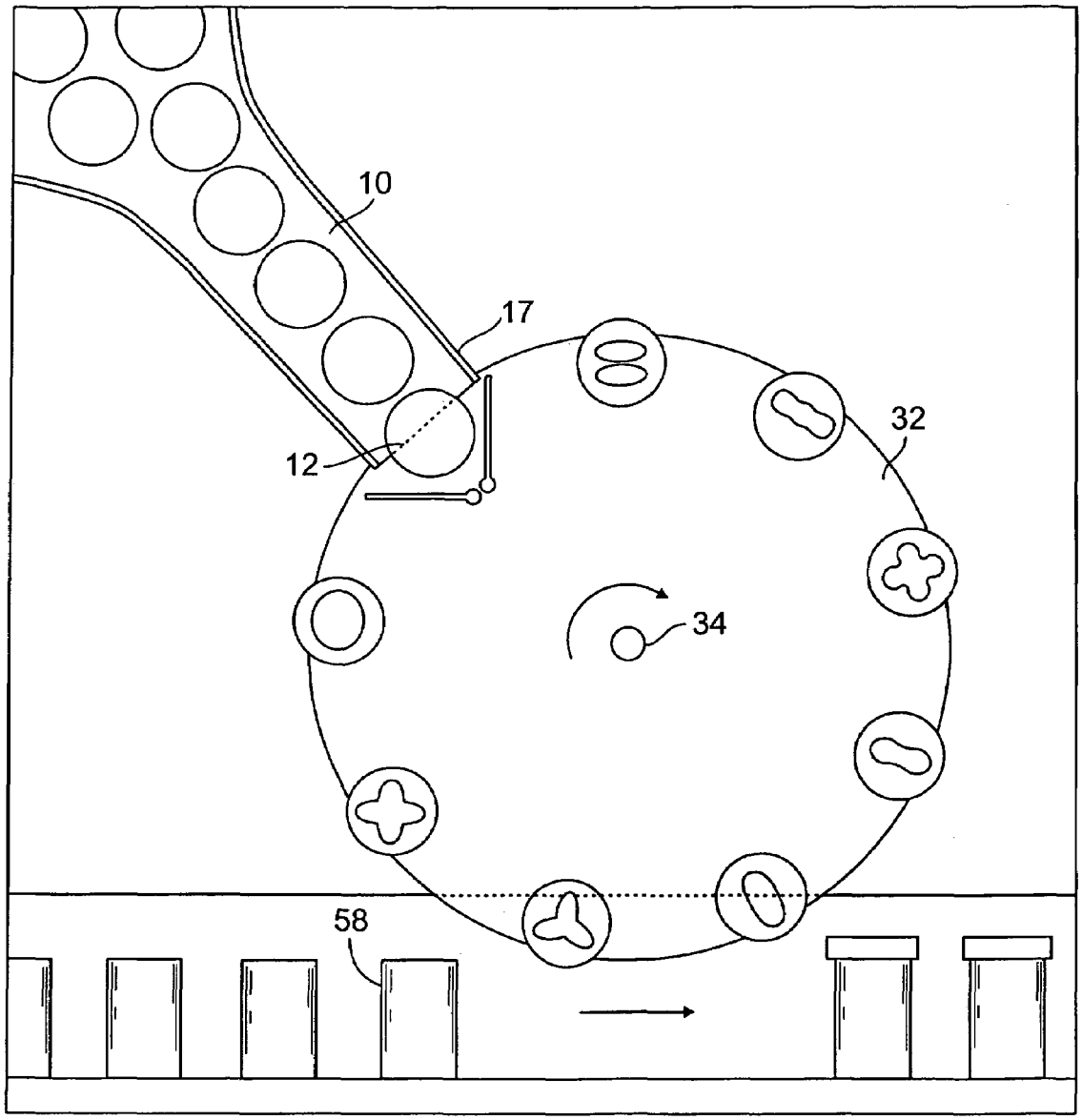
FIG. 3 is a perspective view of one embodiment of a button according to the present invention.
Figure 4:
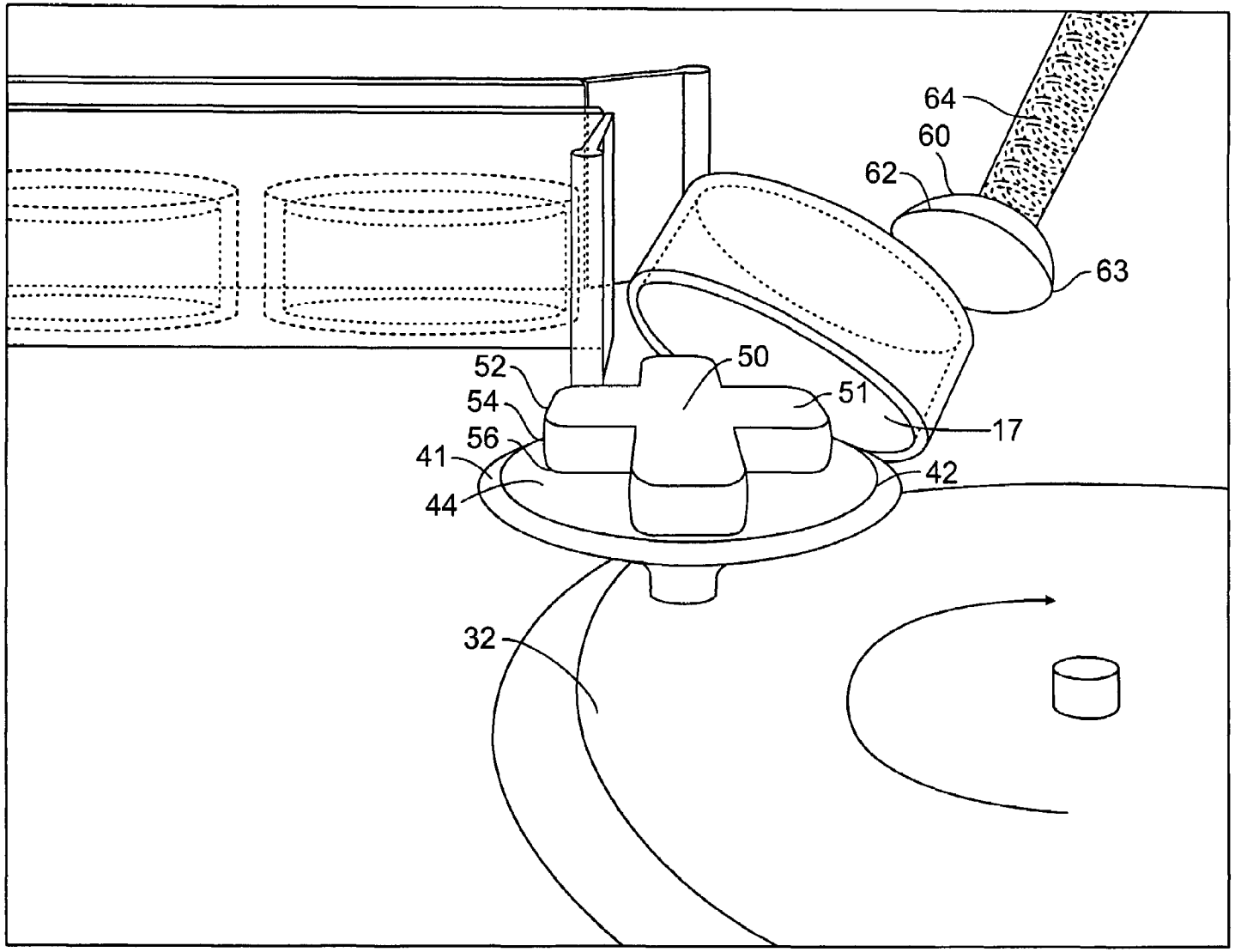
FIG. 4 is a perspective view of one embodiment of the system having a button to transfer closures according to the present invention.

Referring now to FIG. 3, the button 40 can be returnably moved to the chute 10 in an assembly line fashion. The button 40 can be mounted on a shaft (not shown) which is movable by a motor (not shown), manually, or other suitable means. In a preferred embodiment, the button 40 can be mounted on a turret 32. As used herein, the word turret is not intended to denote only a circular moving mechanism, but also one that can move in a longitudinal linear path or other suitable direction. In a preferred embodiment, the turret 32 can have a center point 34 and an outside perimeter 36 which is preferably capable of rotating around turret center point 34. The turret 32 can be rotated manually, but more preferably by a motor (not shown) or other suitable device. Preferably, at least one button 40 can be disposed on the perimeter 36 of the turret 32. Preferably, the turret 32 is located such that the button 40 can be rotated so that can come into contact with a closure 12 at the end 17 of the closure chute 10 and can remove the closure 12 from the chute 10. Further, replicating devices known in the art can be used to remove the closure from the chute, and may align the button 40 similarly.

As can be seen in FIGS. 1-4, the button 40 can have a base 42 that is preferably wider than the outer diameter 22 of the closure 12. Preferably, the base 42 is circular. In one embodiment, the hold backs 30 of the chute 10 can be set at a predetermined distance apart from each other. With this predetermined distance, all round closures 12 in the chute 10 may be expected to protrude relatively the same amount from the chute 10, allowing the button 40 to properly pull the closures 12 from the chute 10. However, oval closures 12 may be narrow axis 24 or broad axis 26 leading. If the closures 12 are narrow axis 24 leading, the closures 12 may protrude further past the hold backs 30 than a round closure 12. If the closures 12 are broad axis 26 leading, the closure 12 may not protrude as far past the hold backs 30 as a round closure 12.

In a preferred embodiment, the base 42 has a substantially planar inner portion 44 and a tapered portion 41. Preferably, the tapered portion 41 is the outer portion of the base 42, however, the tapered portion 41 may be a non-integral feature (not shown) capable of being attached to the button 40 proximate a lead lobe 50 extending from the base 42. In one embodiment, the tapered portion 41 tapers inward and upward toward the lobe 50. The tapered portion 41 allows for the button 40 to remove closures 12 that protrude different distances from the cap chute 10 due to the closures being oval. Closures 12 protruding beyond a predetermined amount may make first contact with the tapered portion 41 of the button 40. As the button 40 passes the chute 10, the angled nature of the tapered portion 41 can allow a closure 12 that protrudes beyond the predetermined amount to slide upward toward inner portion 44, allowing the button 40 to properly pull the closure 12 from the chute 10.

The inner portion 44 can preferably be slightly wider than the closure 12 at its open end 17. The inner portion 44 can be substantially planar to allow the closure 12 to evenly contact it. The inner portion 44 preferably has at least one lobe 50 extending substantially perpendicular therefrom. In a preferred embodiment, the inner portion 44 has a lobe 50 with four extensions 51 or as many of six extensions extending therefrom, with each extension 51 at approximately a ninety degree angle from the adjacent extension 51. Any extension 51 can be set as the lead extension 51 that will make the initial contact with the closure 12 to preferably pull it from the chute 10. The lobe 50 can have a top section 52, middle section 54 and a bottom section 56 that is proximate the inner base 44. The middle section 54 of one or more lobes 50 defines a predetermined perimeter in a plane substantially parallel to the inner base 44. The middle section 54 can be sized so that the closure 12 is properly positioned on the button 40 and will not be easily flipped off the button 40. The middle section 54 can have a perimeter that is slightly less than the closure 12 at its open end 17.

Preferably, the lobe 50 can taper inwards from the middle section 54 to the top section 52. Even more preferably, the lobe 50 tapers in a partially concave fashion. The radius tapering of the lobe 50 can provide a lead and also may act as a spreader for the narrow axis 24 of an oval closure 12. Preferably, the lobe 50 can taper inwards from the middle section 54 to the bottom section 56. In this embodiment, if the closure 12 has threads (not shown), the closure 12 may be pulled downward onto the button 40 as the closure 12 is pulled from the chute 10.

As the closure 12 is pulled from the chute 10, a biasing mechanism 60 can assist in laying the closure 12 flat on the button 40. The biasing mechanism 60 can be an arm or flat plate. In a preferred embodiment, the biasing mechanism 60 can have a biasing surface 62 disposed at a slight upwards angle relative the plane of the button 40. The surface 62 can have a pivot point at a point above the center line of the closure 12. Most preferably, a lower point 63 of the biasing surface 62 is disposed in a spaced relation to the path of the button 40 such that the lower point 63 is slightly above the button 40 when the button passes by the biasing mechanism 60. More preferably, the biasing mechanism 60 is spring loaded with a springing portion 64 or tension screw (not shown) attached thereto. As the closure 12 is pulled onto the button 40, biasing surface 62 can exert a tension against the top of the closure 12. The biasing surface 62 can press the closure 12 flat onto the button 40.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A button to be used to transfer a closure with an opening of a predetermined intended width from a first station to a second station, the button comprising:

a base comprising a substantially planar lower base and a tapered portion; and at least two lobes, each lobe extending substantially perpendicularly out from the base, each lobe having a bottom section proximate the base, a middle section, and a top section spaced outward from the base, wherein the middle section defines a perimeter that is slightly more narrow than the intended width of the closure and the middle section tapers inward to both the top section and bottom section, whereby a closure is placed over the top section of at least one of the at least two lobes during transfer.

2. The button of claim 1 wherein the tapered portion of the base is integral with an outer perimeter of the inner base.

3. The button of claim 1 wherein the lobe comprises four extensions, with each extension disposed at approximately a ninety degree angle from an adjacent extension.

4. The button of claim 1 wherein the middle section tapers, at least partially curvedly, inward to the top section.

5. The button of claim 1 wherein the inner base has a width that is greater than the intended width of the closure such that the closure can rest upon the lower base.

* * * * *